US005911280A

United States Patent [19]

Bald

[11] Patent Number: 5,911,280

[45] Date of Patent: Jun. 15, 1999

[54] APPARATUS AND METHOD FOR REDUCING TRANSVERSE VIBRATIONS IN UNBALANCED-MASS VIBRATORS

[75] Inventor: Hubert Bald, Bad Berleberg, Germany

[73] Assignee: Gedib Ingenieurburo Und Innovationsberatung GmbH, Bad Berleburg, Germany

[21] Appl. No.: 08/765,864

[22] PCT Filed: Jul. 20, 1995

[86] PCT No.: PCT/EP95/02899

§ 371 Date: Jun. 18, 1997

§ 102(e) Date: Jun. 18, 1997

[87] PCT Pub. No.: WO96/03224

PCT Pub. Date: Feb. 8, 1996

[30] Foreign Application Priority Data

Jul. 21, 1994 [DE] Germany ..... 44 25 905

[51] Int. Cl.[6] ..... B06B 1/18; B06B 1/16

[52] U.S. Cl. ..... 173/1; 173/49

[58] Field of Search ..... 173/1, 49, 10, 173/4; 175/19, 56

[56] References Cited

U.S. PATENT DOCUMENTS

| | | | |
|---|---|---|---|
| 4,534,419 | 8/1985 | Vural | 173/1 |
| 4,830,597 | 5/1989 | Steier et al. | 173/49 |
| 4,971,158 | 11/1990 | Salmi | 173/1 |
| 5,281,775 | 1/1994 | Gremillion | 173/49 |
| 5,355,964 | 10/1994 | White | 173/1 |

*Primary Examiner*—Scott A. Smith

*Attorney, Agent, or Firm*—Townsend and Townsend and Crew LLP

[57] ABSTRACT

An unbalanced-mass vibrator comprises a pair of unbalanced masses which are sequentially driven in opposite rotational directions. The vibrators are intended to provide vibrations in a vibrational direction, and undesired vibrations transverse to the vibrational direction are reduced or eliminated. In particular, mechanisms in control schemes are provided for adjusting the relative torques delivered to each of the unbalanced masses via hydraulic motors. The torques, in turn, may be controlled based on the degree to which the unbalanced masses are out of synchronization or by measurically measuring vibrations in a transverse direction to the desired vibrational direction, or time derivative thereof.

12 Claims, 2 Drawing Sheets

122
101
100
134
130
126
118
138
124
120
128
132
136
140
182
116
M1
102
106
114
108
M2
104
142
180
178
158
154
156
166
152
150
144
146
β
$S_Q$
RSE 1
RSE 2
184
176
174
172
168
170
164
148
162
160

254
248
201
200
202
258
244
218
236
240
232
252
256
250
230
260
262
280
246
220
242
228
238
264
234
272
274
296
292
282
290
297
284
280
294
298
226
266
288
286
225
268
270
204
224
278
208
276
214
206
222
216
M1
M2
α

APPARATUS AND METHOD FOR REDUCING TRANSVERSE VIBRATIONS IN UNBALANCED-MASS VIBRATORS

The invention relates to a device and a method for compensating transverse vibrations on unbalanced-mass vibrators having a predetermined vibration direction. In the generic type of vibrator concerned here, the resultant exciting force $F_E$ determining the vibration direction is generated by two synchronously and oppositely rotating groups of part unbalanced-mass bodies, in the simplest instance each group having only a single part unbalanced-mass body.

A further feature of the type of vibrator with which the invention is concerned is that each group has at least one own drive motor, and that the two groups, but at least two part unbalanced-mass bodies belonging in each case to another group, are not or at least not constantly synchronized positively with one another via mechanical drive means, in order to maintain a specific rotary angle position. In the simplest version, a vibrator of this type consists of two part unbalanced-mass bodies which rotate oppositely and synchronously about two axes arranged parallel to one another and each of which is driven by its own motor.

Such vibrators are used for various purposes, synchronism occurring, in a simplest instance, as a result of self-called "self-synchronization" which can easily be achieved under the following conditions: the dynamic mass $m_{dyn}$, which is to be set in vibration by the resultant acceleration or by the resultant unbalance force, must be capable of vibrating in an unimpeded manner (for example, being supported by springs), and a straight line drawn through the mass centre in the vibration direction must be the mid-perpendicular to a line which extends in the plane of the rotating unbalance centres from one axis of rotation to the other.

Vibrators of this type are also used for pile driving. In this case, the fact that positive synchronization between the two groups of part unbalanced-mass bodies by mechanical drive means can be dispensed with is considered to be a particular benefit in operational terms, for example on account of the contribution to noise reduction. Since the invention can be used to particular advantage here, it is described below with regard to pile-driving vibrators.

It may be noted at this juncture, as a reminder, that, in the case of pile-driving vibrators, the dynamic mass $m_{dyn}$, which is set in vibration and which also includes the mass of the driven material, is always connected to a particular carrier appliance (for example, a leader or crane) via special vibration-insulating devices, such as, for example, spring yokes. The entire weight of the dynamic mass is introduced into the carrier appliance via this special vibration-insulating device. In pulling work, the weight to be transmitted also has the pulling force additionally superposed on it.

In the design of pile-driving vibrators of the type in question, care is taken to ensure that the dynamic mass $m_{dyn}$ to be set in vibration in the direction of the longitudinal axis of the driven material is distributed symmetrically, in such a way that the centre of gravity of the dynamic mass is located on a bisecting line which runs through the area centre of gravity of the profile area of the driven material, the said profile area occurring when a section is taken perpendicularly to the longitudinal axis.

Despite complying with this rule, vibration path components transverse to the intended vibration direction may occur on the dynamic mass to such an extent that it is no longer possible to work properly with the vibrator.

Transverse vibrations of this type may, on the one hand, originate from the incorrect orientation of the resultant exciting force $F_E$ of the part unbalanced-mass bodies themselves. The resultant exciting force is coupled kinetically to the dynamic mass and may therefore be influenced, too, by external disturbance forces, for example also as a function of the disturbance in the vibratory movement of the dynamic mass.

On the other hand, however, transverse vibrations may also be excited directly by disturbance forces acting on the dynamic mass. The following are relevant for the generation of such disturbance forces: asymmetric load on the driven material, asymmetric suspension of the dynamic mass, non-horizontal orientation of the exciting body, excitation of force arising from the coupling of the exciting body to the spring yoke or to the leader.

In the attempt to determine the nearest prior art, those vibrators which work according to the teaching of German Patent Specification 41 16 647 must come under consideration. In vibrators of this type, each part unbalanced-mass body is assigned its own drive motor and, remarkably, each motor requires its own drive controller and each drive controller is, in turn, assigned its own angle-measuring system for recording the actual rotary angle position of the respective associated part unbalanced-mass body. In addition, the associated control also requires an overriding position controller which, on the "master motor and slave motor" principle, assigns to each drive controller the rotary angle position which is instantaneously applicable in each case.

However, such a solution is highly cost-intensive and very complicated in terms of apparatus and is therefore, inter alia, also particularly susceptible to faults. Such a solution consequently cannot be considered for use in pile-driving vibrators which, for example, operate under rough construction conditions. Motor-controlled vibrators according to German Patent Specification 41 16 647 are, in principle, also not intended for the purpose of compensating transverse vibrations, since the function of all drive controllers is to synchronize the part unbalanced-mass bodies as though they were being synchronized via a toothed gearing. The resultant acceleration is always set in the same predetermined direction. A vibrator controlled in this way therefore cannot compensate externally excited transverse vibrations of the dynamic mass.

This directional vibrator according to German Patent Specification 41 16 647 comprises two twin-shaft vibrators which must be imagined as being placed one on the other, the part unbalanced-mass bodies of one vibrator, which cooperate in each case (and can be imagined as lying one above the other) having a direction of rotation which is opposite to that of the other. The average person skilled in the art knows that these cooperating part unbalanced-mass bodies can also rotate in the same direction, as implemented in WO93/01693 discussed later; the two designs are equivalent to one another.

EP-A-0,467,758 discloses a directional vibrator, likewise with two twin-shaft vibrators which are arranged one above the other and the respective unbalances of which are coupled via gearwheels and are consequently synchronized positively. The phase relationship of the two vibrators can be adjusted hydraulically in relation one to the other via a planetary gear, but the vibration direction cannot be changed on account of the positive synchronization.

The object of the invention is to provide a device which is simpler and more robust than the nearest prior art and by means of which all types of undesirable transverse vibrations can be reduced in magnitude or even avoided. In order to approach the desired robustness, the sought-after improvement is, in this case, to be restricted to solutions employing only hydraulic drive motors. The expected solution is to be so much simpler that it is possible, for example, for at least two hydraulic drive motors, which are to be assigned to different groups, to be subjected to a common pressure source (the feature of the pre-characterizing clause of claims 1 and 10).

The solution for achieving the object is defined in the two independent Patent claims 1 and 10. Further advantageous developments of the invention are reproduced in the subclaims.

The advantage of the solution according to the invention is to be seen in that the controlling action on the rotary drive for influencing the direction of the resultant exciting force relates only to throttling measures which can be implemented at a low outlay in terms of apparatus and for which, for example, it is not necessary to vary the pressure of the pressure source. The throttling losses to be taken into account in this case, and which depend on the magnitude of the transverse vibrations, are low, since, in principle, the transverse vibrations are, of course, prevented. Furthermore, the chosen principle for influencing the direction of the resultant exciting force is more effective than the complicated technique according to the nearest prior art mentioned. Contrary to the prior art, the principle according to the invention can also guide the direction of the resultant exciting force in a direction deviating from the predetermined vibration direction (in the manner of overcompensation). As a consequence, when the transverse vibrations are reduced to minimum values by means of the controlling operation, for example internal acceleration (generated by unbalanced forces) can be generated, this being opposite to the external acceleration (exciting to transverse vibration).

The two independent claims 1 and 10 are based on the same general inventive idea. According to this, the undesirable transverse vibrations of the dynamic mass $m_{dyn}$ are not overcome by passive means (damping), but are compensated by means of an active measure by making a correction to the direction of the resultant exciting force as a function of the value of a physical quantity which is to be measured or to be taken into account and which is in a functional relation to the transverse vibration, the said correction being carried out by influencing, on at least one group, the resultant torque (that is to say, the sum of driving and braking torques) which causes the rotation of the unbalanced-mass bodies.

The characterizing clauses of claims 1 and 10 specify, as the physical quantity to be measured or evaluated, both the path $S_Q$ of the transverse vibratory movement itself or the quantities derived from this, such as, for example, $S_{Q'}$ or $S_{Q''}$, and the relative rotary angle of the part unbalanced-mass bodies which generate the exciting forces. In this case, the "relative rotary angle" is an angle which must be determined by a comparison of the rotary angle positions of two part unbalanced-mass bodies.

The invention is explained in more detail by the description of two examples with reference to FIGS. 1 and 2:

Figure 1:
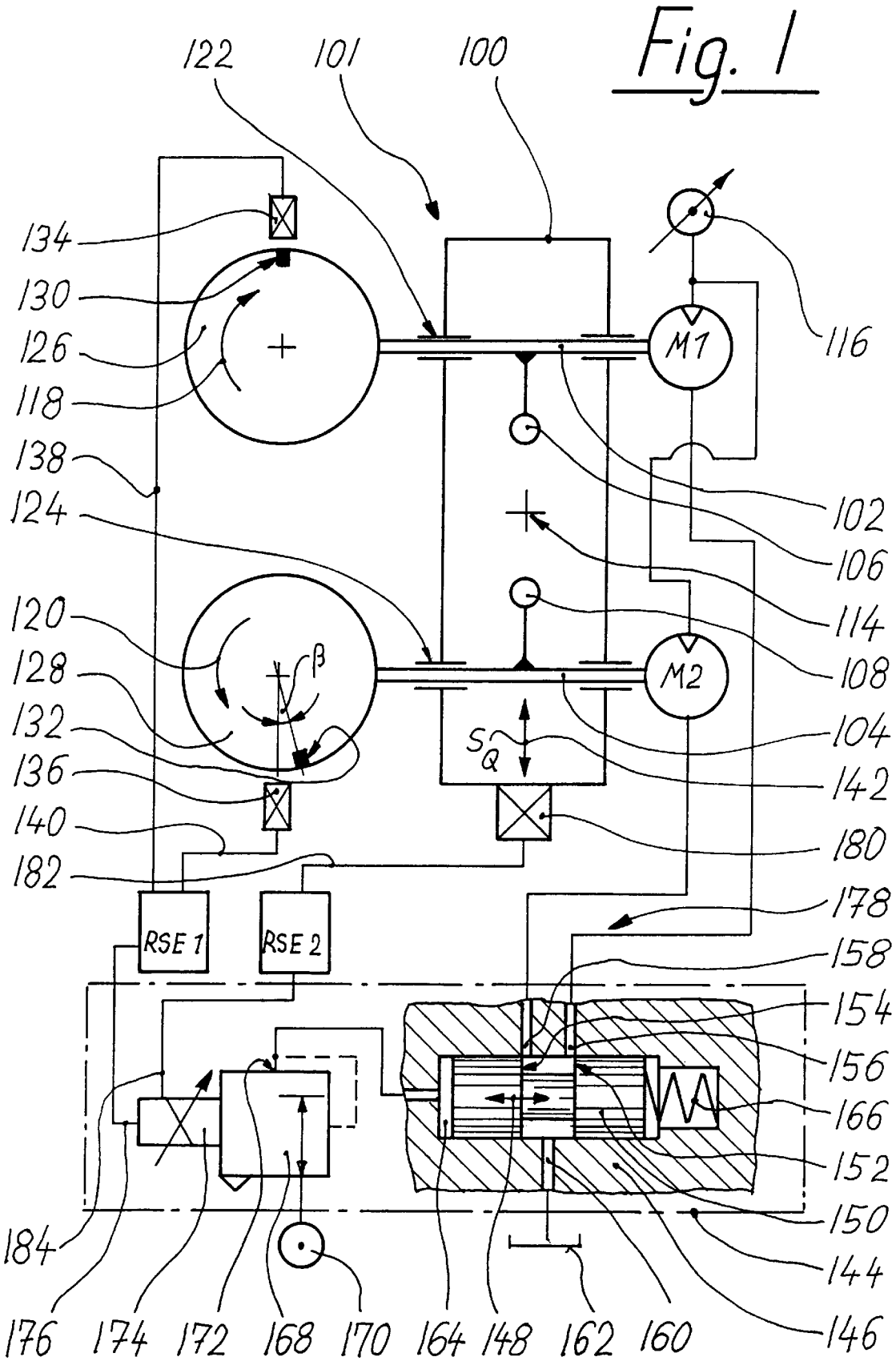
FIG. 1 shows diagrammatically a directional vibrator with two part unbalanced-mass bodies, with two electrical measuring devices for recording the rotary angles of two part unbalanced-mass bodies and for recording vibration paths and with a correction setting device for influencing the torques of the two drive motors.

In FIG. 1, the frame 100 represents the housing of an unbalanced-mass vibrator 101 which is operated by means of two part unbalanced-mass bodies 106 and 108 fastened to the two shafts 102 and 104 an driven by two hydraulic motors M1 and M2. The centre of gravity of the dynamic mass is identified by the cross 114. If the vibrator is used for the driving of driven material, the mass centre of gravity of the driven material coincides with the centre of gravity 114 and the driven-material mass is also included in the dynamic mass $m_{dyn}$.

The two hydraulic motors M1 and M2 of equal size are subjected to variable pressure from a common pressure source 116. After the motors have been started with opposite directions of rotation identified by the arrows 118 and 120, the arrangement provided for the mass centre of gravity 114 results in self-synchronization of the rotational movement of the two part unbalanced-mass bodies 106 and 108, so that these rotate synchronously in opposite directions.

In a plane which can be drawn through the centre lines of the shafts 102 and 104, the centrifugal forces compensate one another, whilst, in a direction perpendicular to the drawing plane, they are added to the resultant exciting force $F_E$ which must be conceived as running through the centre of gravity 114. The resultant exciting force $F_E$ sets the dynamic mass $m_{dyn}$ in vibratory movement in the predetermined vibration direction perpendicular to the drawing plane and with the amplitude $A=m_{dyn}/M$, M being the maximum resultant centrifugal moment arising from the part centrifugal moments M/2 of the two part unbalanced-mass bodies.

If the vibratory movement of the dynamic mass is impeded, the rotating part unbalanced-mass bodies, in conjunction with mass forces carried via the bearings 122, 124 and generated by the vibrating dynamic mass $m_{dyn}$, deploy special "synchronous guidance torques" which, within a specific framework of disturbance forces, ensure the synchronism of the two part unbalanced-mass bodies, without these having to be positively synchronized by mechanical drive means, such as, for example, gearwheels.

Conversely, if an attempt is made to change the synchronism of the part unbalanced-mass bodies (thereby also changing the direction of the resultant exciting force), this is achieved only if additional setting torques are generated via the motors.

Connected to the shafts 102, 104 are co-rotating feature carriers 126, 128 carrying, on their circumference, position features 130, 132 which are detected, during rotation, by the position sensors 134, 136, the sensors transmitting signals via the signal lines 138, 140. These signals are processed in the regulating or control device RSE1, in such a way that deviations from a predetermined relative angular position of the two part unbalanced-mass bodies can be determined there as "relative rotary angles" in terms of their path and direction.

FIG. 1 shows, at the position sensor 136, a relative rotary angle β which deviates from the true synchronous position and which originates from a lead of the part unbalanced-mass body 108 in the direction of the arrow 120. If such a relative rotary angle β deviating from the value zero is present, it may be assumed that the direction of the resultant exciting force $F_E$ is deflected out of its desired direction, and that transverse vibrations having a path component $S_Q$ (142) consequently occur. By means of the correction setting device 178, which, in addition to the regulating or control device RSE1, also includes the actuator 144, the relative rotary angle is then to be returned to the value zero again.

The actuator 144 has a throttling device 146, by means of which the volume flows emerging from the motors M1 and M2 can be selectively throttled. The throttling of one volume flow or the other is carried out by displacing the control piston 150 out of the middle position shown, the said displacement taking place in the direction of the double arrow 148. In the event of displacement to the left, the control edge 152 narrows the inlet duct 156 of the volume flow coming from the motor M1, and, in the event of displacement to the right, the inlet duct 158 of the volume flow emerging from the motor M2 is reduced in size. The outflow duct 160 leading to the tank 162 is not affected by the displacement of the control piston, so that the non-throttled volume flow can flow out, unimpeded, at any time.

The control piston 150 is displaced by means of the difference between force generated, on the one hand, by a compression spring 166 and a hydraulic force generated, on the other hand, by pressuring the control-pressure space 164. The hydraulic pressure in the control-pressure space is determined by the outlet pressure of an electrically activatable pressure-regulating valve 168, by means of which the pressure predetermined by a constant-pressure source 170 can be regulated down to any predeterminable pressures at the outlet 172. The magnitude of the regulated outlet pressure which can be set at the outlet 172 is determined, with the cooperation of the electrical control member 174, by the output signal from the regulating or control device RSE1 which is fed via the line 176.

Attached to the frame 100 is a sensor 180 for recording the acceleration $S_{Q''}$ assigned to the vibration path $S_Q$ (142), the signal from the said sensor being fed via the signal line 182 to the regulating or control device RSE2. In the regulating or control device RSE2, the information of the input signal is processed in such a way that the output signal, which is fed to the electrical control member 178 via the line 184, also contains the necessary information on the value and direction of the quantity measured by the sensor 180, so that, via the pressure-regulating valve 168 and the throttling device 146, similar reactions can be brought about on the motors M1 and M2 to those which can be achieved by the influence of the output signal from RSE1.

A correction setting operation is executed as follows: in the simplest instance, when a relative rotary angle β or a vibration path component $S_Q$ occurs the regulating or control devices RSE1 or RSE2 give rise, via their output signals, to an adjustment of the throttling device 146 and consequently to the generation of a setting torque on one of the motors in proportion to the measured value of the disturbance β or $S_Q$.

If, for example, the relative rotary angle β is evaluated for compensating the transverse vibration, the regulating or control device RSE1 will ensure that the control piston 150 is displaced to the right, with the result that the torque of the motor M2 is reduced and with the result that a setting torque builds up in comparison with the motor M1, the relative rotary angle β being reduced again by means of the said setting torque.

However, the regulating or control devices RSE1 and RSE2 can be provided with further additional functions which they utilize, depending on the operating situation of the vibrator. These include, for example, an integration function along the lines of control technology, so that the disturbances can be compensated so as also to be free of residual error, or an algorithm which can activate the output signals individually or jointly according to predetermined criteria.

Of course, it may also be sufficient to work with a correction setting device which operates solely with one of the two input quantities β or $S_Q$.

Figure 2:
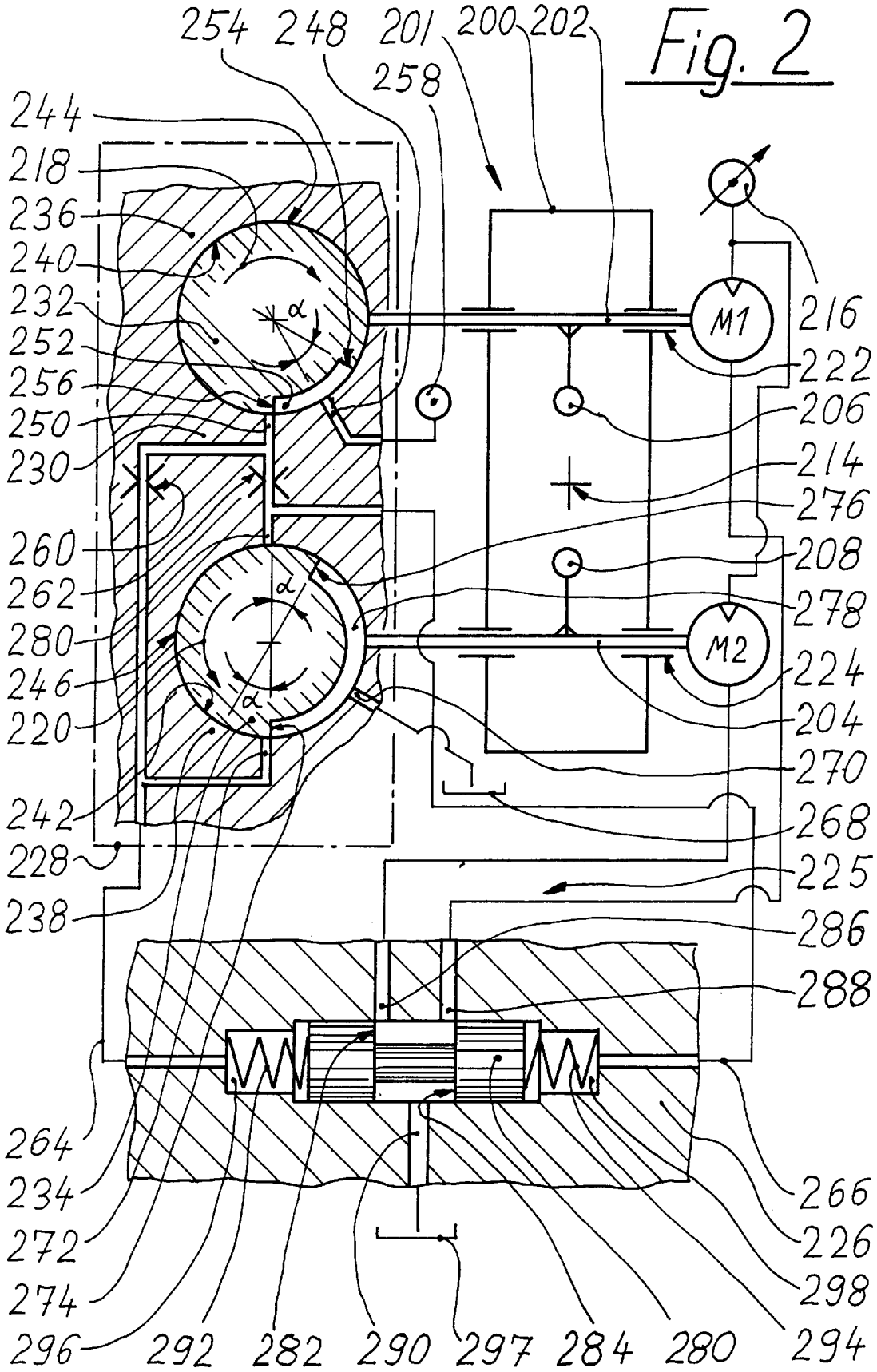
FIG. 2 shows diagrammatically the same overall device as in FIG. 1, with only the difference that the measuring device measures only one relative rotary angle, specifically hydraulically.

FIG. 2 shows an unbalanced-mass vibrator 201 which is to have the same properties as that shown in FIG. 1, insofar as relates to features 200 to 220 and to the motors M1 and M2. In this case, the identifying numbers of the same features in the two Figures have identical combinations of the last two numerals.

The difference between the unbalanced-mass vibrator 201 in FIG. 2 and that according to 101 in FIG. 1 is solely a different design of the correction setting device 225. This consists, in FIG. 2, of the actuator 226 and of the regulating or control device 228 together with the sensor part 230.

The sensor part 230 is formed by two control rotors 232 and 234 with a control groove and control edges on the circumference of their outer cylinders 244, 246 and by two control stators 236 and 238 with control orifices on the circumference of their inner cylinders 240, 242.

The two control rotors 232 and 234 are designed as cylindrical bodies which are connected (in a way not shown) fixedly in terms of rotation to the shafts 202 and 204 and thus rotate synchronously with these and with the part unbalanced-mass bodies. The outer cylinders 244, 246 of the control rotors 232, 234 are fitted, with a narrow cylindrical sealing gap, into the inner cylinders 240, 242 of the control stators 236, 238, so that leakage flowing out through these sealing gaps can be ignored.

Set into the outer cylinder 244 is a control groove 252 which forms 2 control edges 252 and 254. The space of the control groove 252 can be connected to a pressure source 258 via the control orifice 248. In the basic position shown, associated with a relative rotary angle=zero, the control edge 256 is just on the point of connecting the control orifice 250 to the control groove 252. When the control rotor 232 is rotated further in the direction of the arrow 218, the control orifice 250 is connected to the control orifice 248 and consequently to the pressure source 258. This connection exists over a rotary angle α, until the control edge 254 closes the control orifice 248 again.

The control orifice 250 is connected, with throttling bodies 260 and 262 being interposed, to the control lines 264 and 266 which carry the output signals from the regulating or control device 228. As a result, the pressure present in the control orifice 250 also prevails in the control lines 264, 266, insofar as one of these control lines is not connected to the pressureless tank 268 as a result of influence exerted by the control rotor 234.

Located in the actuator 226 is a control piston 280, during the lateral movement of which inlet ducts 286, 288 can be shut off or throttled by the control edges 282, 284, whilst a central outflow duct 290 always remains open towards the pressureless tank 297. The throttling of the volume flows flowing out from the motors through the inlet ducts can achieve the same effects with regard to the generation of setting torques as was explained with regard to FIG. 1.

The control piston is held in the basic position shown as a result of the effect of two springs 292, 294. In the event that the control lines 264, 266, to which the control-pressure spaces 296, 298 are connected, have the same pressures with the same pulse duration at the same time, the control piston 280 keeps the basic position shown. However, as soon as the pulse duration of the pressure pulses on both sides of the control piston is changed, whilst the pressure head remains the same, the control piston 280 is displaced to one side or the other.

Variation of the pulse duration on one control line or the other in dependence on relative rotary angles of the two part unbalanced-mass bodies or of the two control rotors is the function of the control edges 274, 276 which are formed by the control groove 278 on the outer cylinder of the control rotor 234. In the basic position shown, which corresponds to the value zero of a relative rotary angle, the control edge 274 has just closed the control orifice 272, allowing for the direction of rotation 220, whilst the control edge 276 begins to open the control orifices 280 after the further rotation of the two control rotors through the angle $\alpha$, although, precisely at this moment, pressure from the pressure pulses generated by the control rotor 232 is no longer present at the control orifice 280.

It can be seen that, when the rotary angle to be assigned to the part unbalanced-mass body 208 is retarded, that is to say when a negative relative rotary angle occurs, the control edge 274 closes the control orifice 272 too late, so that, as a result of the outflow of a volume flow through the control groove 278 and through the outflow orifice 270, which is never closed, towards the pressureless tank 268, the pressure in the control line 264 is temporarily reduced, as a result of which the pulse duration of the pressure pulse becomes shorter. In the event of a lead of the rotary angle of the control rotor 234, that is to say when a positive relative angle occurs, the control edge 276 opens the control orifice 280 too early, thus resulting in a shortening of the pulse duration of the pressure pulses present on the control line 266.

If the product of the pulse pressure p and pulse time $t_1$ on the control line 264 or the pulse time $t_2$ on the control line 266 is added up over a specific period of time, the pulses I1 and I2 are obtained as $I1=\Sigma p^*t_1$ or $I2=\Sigma p^*t_2$. With the difference $\delta I=I1-I2$, a directional pulse $\delta I$ of specific direction, related to unit of area, is obtained as a function of the times $t_1$ and $t_2$, the said directional pulse being critical, in terms of magnitude and direction (together with the mass of the control piston to be moved and with the spring constants of the cooperating springs), for the displacement of the control piston 280. This directional pulse $\delta I$ acting on the actuator 226 can also be considered as the information content of the output signal from the regulating or control device 228 which is transmitted via the two control lines 264 and 266.

The following advantageous modifications may be carried out on the unbalanced-mass vibrators described:

The path component $S_Q$ (142) of the transverse vibration can also be recorded by means of a special hydraulic sensor part in a manner comparable to the mode of operation of the sensor part 230 in FIG. 2. In this case, the vibratory acceleration would set an auxiliary mass in vibrating movement, as a result of which movement flow cross-sections of hydraulic volume flows are modified with the effect of a desired shutting-off or throttling effect (claim 6).

Instead of the measure of generating a setting torque by the variation of motor torques, there could also be provision for using power-operated braking members for generating a setting torque exerting a braking effect on the unbalanced-mass shafts, in which case the actuators would have to apply actuating energy to the said braking members.

If, in the unbalanced-mass vibrators 101 and 201, the part unbalanced-mass bodies, together with the shafts and motors, are designed in a double arrangement, two groups of part unbalanced-mass bodies, with the same direction of rotation within the group and with opposite directions of rotation from group to group, are obtained. By means of an arrangement of this type, if the four motors are appropriately controlled in a known way (as shown, for example, in the publication PCT/EP93/01693), a relative setting angle of predetermined size can be set between the part unbalanced-mass bodies rotating in each case in opposite directions, as a result of which the total resultant centrifugal moment is also set in a predeterminable way.

In an unbalanced-mass vibrator of this type, the present invention is required particularly urgently in order to ensure that the vibrator will function at all. For this purpose, according to FIGS. 1 or 2, it is really necessary to vary the relative rotary angle between two respective part unbalanced-mass bodies of various groups (claim 8).

The actual value of the relative setting angle, likewise to be regulated during the regulating of the resultant centrifugal moment (for example, according to the teaching of publication PCT/EP93/01693, is determined by using an angle-measuring device. In this case, in such vibrators, the rotary angles of two part unbalanced-mass bodies, which in this case may belong to one and the same group, are continuously recorded digitally purely for the feed of the angle-measuring device. It is therefore particularly advantageous, in the compensation of transverse vibrations on such vibrators, to make use, at least partially, also of hardware components of the angle-measuring device for the sensor assembly required for determining the relative rotary angle $\beta$ and/or for information processing (claim 9).

The regulating and control device can include the function of an integrating member, as a result of which, as is known, the control deviation, which is the difference between the desired value and actual value of the control quantity, can be returned to the value zero (claim 11).

Instead of being used for compensating undesirable transverse vibrations, the devices described may alternatively also be used for generating transverse vibrations artificially. For this purpose, the actuators simply have to be controlled by a different or differently working control device.

The terms used in connection with the description or functions of the control regulating technology are taken from the standard specification of DIN 19226 or at least follow these standard terms.

I claim:

1. An unbalanced-mass vibrator having a predetermined vibration direction, said vibrator comprising:

a frame;

two unbalanced-mass body means (106, 108) rotably mounted on the frame;

at least one hydraulic drive motor (M1) coupled to drive a first unbalanced mass body means in a first rotational direction;

at least one hydraulic drive motor (M2) coupled to drive a second unbalanced mass body means in a second rotational direction;

a common hydraulic pressure source connected to each of the hydraulic drive motors, wherein the two unbalanced mass body means are driven synchronously but in opposite directions;

means for measuring deviation of a physical quantity selected from the group consisting of rotary angle and vibration path from a desired value, wherein a deviation is rotary angle is based on the rotary position of at least one part of one of the unbalanced mass body means and a deviation in vibration path is based on a measurement $S_Q$ made perpendicularly to the predetermined vibration direction or on a time derivative of $S_Q$; and an actuator which controls the rotation of at least one of the drive motors based on the deviation measured by the measuring means, wherein control is effected by adjusting the differential pressure of hydraulic fluid flowing to the two hydraulic drive motors to adjust the relative torques applied to the two motors.

2. An unbalanced-mass vibrator as in claim 1, wherein the actuator controls the torque on at least one of the hydraulic drive motors.

3. An unbalanced-mass vibrator as in claim 1, wherein each unbalanced-mass body means includes at least two parts.

4. An unbalanced-mass vibrator as in claim 1, wherein the actuator throttles a flow of hydraulic fluid to or from at least one of the hydraulic motors in order to affect the differential pressure and control the torque.

5. An unbalanced-mass vibrator as in claim 4, further comprising a hydraulic regulating device (228) having a sensor (230) which senses the angular deviation of the two mass body means and which throttles at preselected throttling points.

6. An unbalanced-mass vibrator as in claim 4, further comprising a sensor which determines vibratory acceleration in a direction perpendicular to the vibration direction, and a movable axillary mass which effects the throttling.

7. An unbalanced-mass vibrator as in claim 1, further comprising an electrical sensor which measures either (a) vibration path, speed, or acceleration or (b) relative rotary angle between the two unbalanced-mass body parts.

8. An unbalanced-mass vibrator as in claim 1, further comprising means for adjusting the static angle between the two mass body means.

9. An unbalanced-mass vibrator as in claim 8, further comprising electrical sensors for determining the relative rotary angles of the two mass body means and an electrical controller for determining the adjustment required.

10. A method for reducing undesirable vibrations in an unbalanced-mass vibrator having a direction of vibration, wherein the undesirable vibrations are transverse to the direction of vibration, said vibrator comprising:

a frame;

two unbalanced-mass body means (106, 108) rotably mounted on the frame;

at least one hydraulic drive motor (M1) coupled to drive a first unbalanced mass body means in a first rotational direction;

at least one hydraulic drive motor (M2) coupled to drive a second unbalanced mass body means in a second rotational direction; and a common hydraulic pressure source connected to each of the hydraulic drive motors, wherein the two unbalanced mass body means are driven synchronously but in opposite directions;

wherein the method comprises:

determining a value of deviation from vibration direction time derivative thereof, or determining the relative rotary angle value between the two unbalanced mass body means;

generating a control value based on the determined value;

adjusting the hydraulic flow to at least one of the hydraulic motors based on the generated control valve in order to adjust the relative torque supplied to the unbalanced masses to reduce the undesired vibration.

11. A method as in claim 10, wherein the control valve is based partly on the integral of deviation over time.

12. A method as in claim 10, wherein the relative rotary angle is measured based on at least one part of each of the unbalanced mass body means.

* * * * *